US008818213B2

(12) United States Patent
Tanaka

(10) Patent No.: US 8,818,213 B2
(45) Date of Patent: Aug. 26, 2014

(54) IMAGE FORMING APPARATUS THAT DETECTS TIMING FOR MAINTENANCE

(75) Inventor: Yoshiaki Tanaka, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 5 days.

(21) Appl. No.: 13/587,556

(22) Filed: Aug. 16, 2012

(65) Prior Publication Data

US 2013/0051820 A1 Feb. 28, 2013

Related U.S. Application Data

(60) Provisional application No. 61/528,659, filed on Aug. 29, 2011, provisional application No. 61/528,662, filed on Aug. 29, 2011.

(51) Int. Cl.
*G03G 15/00* (2006.01)

(52) U.S. Cl.
CPC ..... *G03G 15/00* (2013.01)
USPC ..... 399/25

(58) Field of Classification Search
CPC ..... G03G 15/00
See application file for complete search history.

(56) References Cited

U.S. PATENT DOCUMENTS 6,298,202 B1 * 10/2001 Fushiya et al. ..... 399/12

FOREIGN PATENT DOCUMENTS

| | | | | |
|---|---|---|---|---|
| JP | H05204195 | * | 8/1993 | ..... G03G 15/00 |
| JP | 2000221781 | * | 11/2000 | ..... G03G 15/08 |
| JP | 2001222204 | * | 8/2001 | ..... G03G 15/00 |
| JP | 2004077988 | * | 11/2004 | ..... G02G 21/00 |
| JP | 2009-145912 | | 7/2009 | |
| JP | 2009-265401 | | 11/2009 | |

* cited by examiner

*Primary Examiner* — Clayton E Laballe
*Assistant Examiner* — Kevin Butler
(74) *Attorney, Agent, or Firm* — Patterson & Sheridan, LLP

(57) ABSTRACT

According to one embodiment, a process unit includes a process section present around an image bearing member, attached and detached to and from a body, including a rotating section, and configured to apply an image forming process to the image bearing member, a moving section present on a shaft of the rotating section and configured to slide to a first position close to the rotating section and a second position away from the rotating section, and a positioning section present between the rotating section and the moving section and configured to move following the rotating section and hold the moving section in the first position and the second position.

8 Claims, 7 Drawing Sheets

IMAGE FORMING APPARATUS THAT DETECTS TIMING FOR MAINTENANCE

CROSS-REFERENCE TO RELATED APPLICATION

This application is based upon and claims the benefit of priority from Provisional U.S. Applications 61/528,659 filed on Aug. 29, 2011 and 61/528,662 filed on Aug. 29, 2011 the entire contents of which are incorporated herein by reference.

FIELD

Embodiments described herein relate generally to an image forming apparatus such as a copying machine or a printer including a process unit detachably attachable to a body.

BACKGROUND

As a copying machine or a printer, there is an image forming apparatus that attaches and detaches, to and from an image forming apparatus body, a process unit in which process sections that apply an electrophotographic process to photoconductive members are integrally formed. If the process unit is used, when an operator performs operation such as counter reset for determining timing for maintenance such as replacement of expendable supplies or the process sections, it is likely that workability during the maintenance is deteriorated. If a determination component such as a fuse is used to determine timing for maintenance of the process unit, it is likely that costs increase and workability is deteriorated because replacement of the determination component is necessary.

DETAILED DESCRIPTION

In general, according to one embodiment, a process unit includes: a process section present around an image bearing member, attached and detached to and from a body, including a rotating section, and configured to apply an image forming process to the image bearing member; a moving section present on a shaft of the rotating section and configured to slide to a first position close to the rotating section and a second position away from the rotating section; and a positioning section present between the rotating section and the moving section and configured to move following the rotating section and hold the moving section in the first position and the second position.

Figure 1:
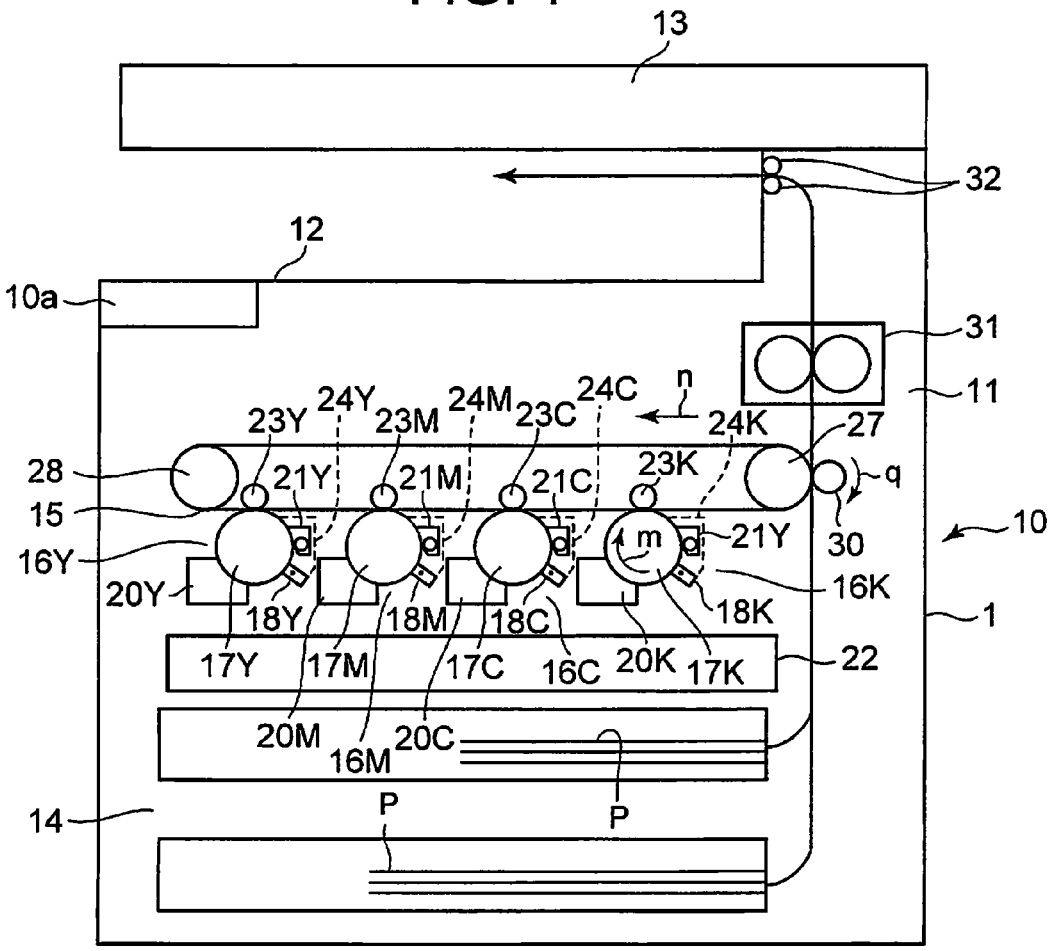
FIG. 1 is a schematic configuration diagram of an MFP mounted with a process unit according to an embodiment.

An embodiment is explained below. An MFP (Multi Functional Peripheral) 10, which is an image forming apparatus, shown in FIG. 1 includes, in a housing 1, which is a body of the MFP 10, a printer section 11 that forms an image, a paper discharge section 12 that stores a sheet P discharged from the printer section 11, a scanner section 13 that reads an image, and a paper feeding section 14 that feeds the sheet P. The MFP 10 includes a control panel 10*a*, which is a user interface.

Figure 2:
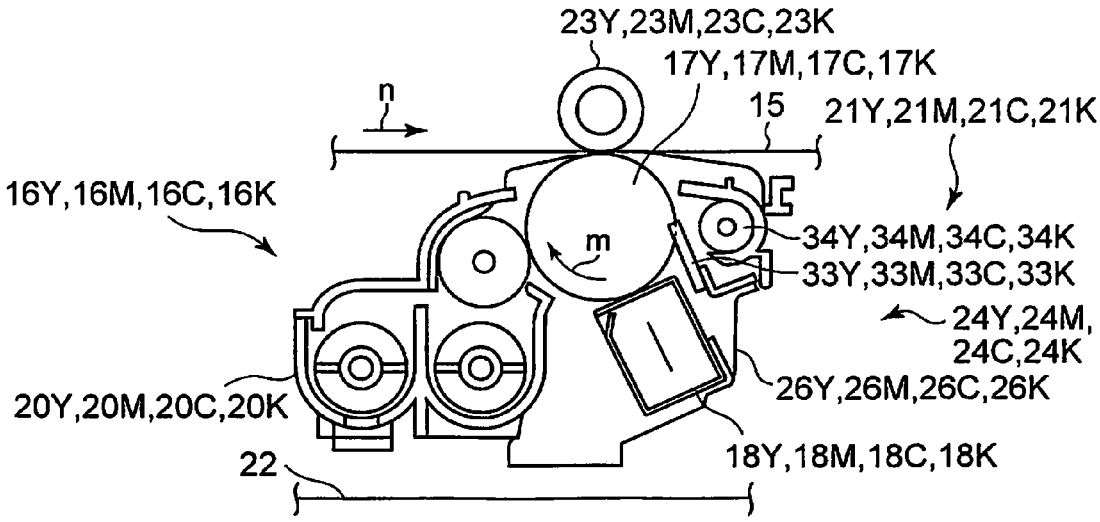
FIG. 2 is a schematic configuration diagram of an image forming unit in the embodiment viewed from the front side.

The printer section 11 includes four sets of image forming stations 16Y, 16M, 16C, and 16K for Y (yellow), M (magenta), C (cyan), and K (black) arranged in parallel along the lower side of an intermediate transfer belt 15. As shown in FIG. 2, the image forming stations 16Y, 16M, 16C, and 16K respectively include chargers 18Y, 18M, 18C, and 18K, developing devices 20Y, 20M, 20C, and 20K, and cleaners 21Y, 21M, 21C, and 21K around photoconductive drums 17Y, 17M, 17C, and 17K, which are image bearing members that rotate in an arrow m direction.

The chargers 18Y, 18M, 18C, and 18K respectively perform a charging process for the photoconductive drums 17Y, 17M, 17C, and 17K. The cleaners 21Y, 21M, 21C, and 21K included in the process section respectively perform a cleaning process for removing and collecting toners remaining on the photoconductive drums 17Y, 17M, 17C, and 17K after primary transfer.

The cleaners 21Y, 21M, 21C, and 21K respectively include cleaning blades 33Y, 33M, 33C, and 33K, and toner augers 34Y, 34M, 34C, and 34K, which are rotating sections. Shafts 34*a* of the toner augers 34Y, 34M, 34C, and 34K respectively rotate in association with the photoconductive drums 17Y, 17M, 17C, and 17K.

The photoconductive drums 17Y, 17M, 17C, and 17K, the chargers 18Y, 18M, 18C, and 18K, and the cleaners 21Y, 21M, 21C, and 21K of the image forming stations 16Y, 16M, 16C, and 16K are respectively integrally incorporated in frames 26Y, 26M, 26C, and 26K to form process units 24Y, 24M, 24C, and 24K. The photoconductive drums 17 (17Y, 17M, 17C, and 17K), the chargers 18 (18Y, 18M, 18C, and 18K), and the cleaners 21 (21Y, 21M, 21C, and 21K) of the process units 24Y, 24M, 24C, and 24K are integrally detached from the housing 1 and integrally attached to the housing 1.

An exposing device 22 of the printer section 11 forms electrostatic latent images corresponding to the respective colors on the photoconductive drums 17Y, 17M, 17C, and 17K. The printer section 11 includes a backup roller 27 and a driven roller 28 that support the intermediate transfer belt 15. The printer section 11 causes the intermediate transfer belt 15 to travel in an arrow n direction. The printer section 11 includes primary transfer rollers 23Y, 23M, 23C, and 23K respectively in positions opposed to the photoconductive drums 17Y, 17M, 17C, and 17K via the intermediate transfer belt 15. The primary transfer rollers 23Y, 23M, 23C, and 23K respectively primarily transfer toner images formed on the photoconductive drums 17Y, 17M, 17C, and 17K onto the intermediate transfer belt 15. The toner images of the respective colors are sequentially superimposed on the intermediate transfer belt 15.

The printer section 11 includes a secondary transfer roller 30 in a position opposed to the backup roller 27 via the intermediate transfer belt 15. The secondary transfer roller 30 rotates in an arrow q direction following the intermediate transfer belt 15.

The paper feeding section 14 feeds the sheet P to the position of the secondary transfer roller 30 at timing when the toner images on the intermediate transfer belt 15 reach the position of the secondary transfer roller 30. During secondary transfer, the printer section 11 forms a transfer bias in a nip between the intermediate transfer belt 15 and the secondary transfer roller 30 and collectively secondarily transfers the toner images on the intermediate transfer belt 15 onto the sheet P. The printer section 11 includes a fuser 31 and a paper discharge roller pair 32 downstream of the secondary transfer roller 30.

The MFP 10 transfers the toner images formed by the printer section 11 onto the sheet P through a print process and, after fixing the toner images, discharges the sheet P to the paper discharge section 12.

The image forming apparatus is not limited to a tandem system. The number of image forming stations is not limited either. The image forming apparatus may directly transfer toner images from photoconductive members onto a sheet.

Figure 3:
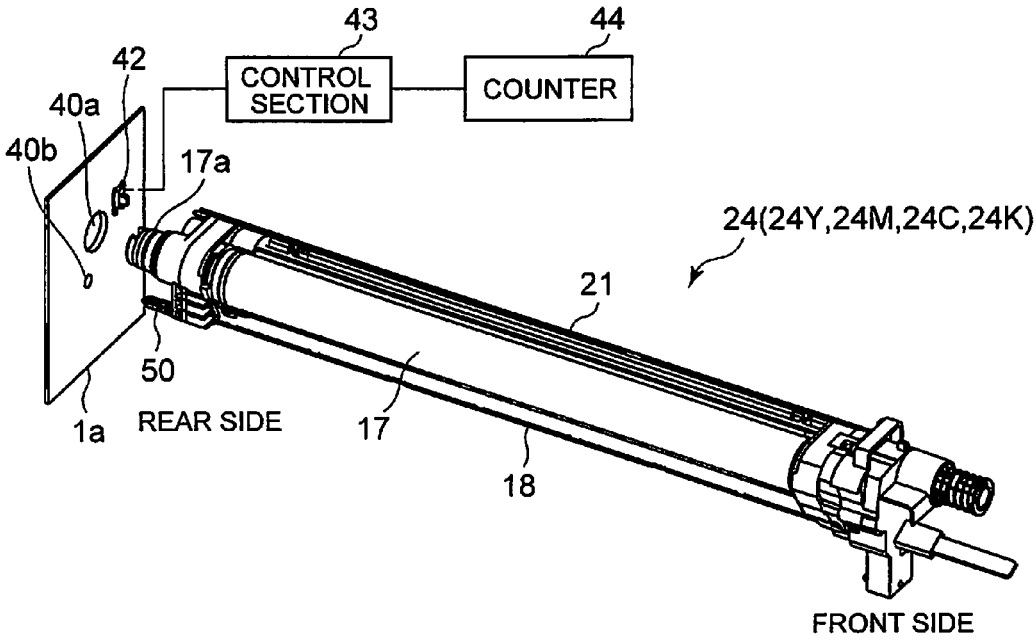
FIG. 3 is a schematic perspective view of the image forming unit viewed from a photoconductive drum side and a schematic block diagram for mainly explaining maintenance control for the process unit.
Figure 4:
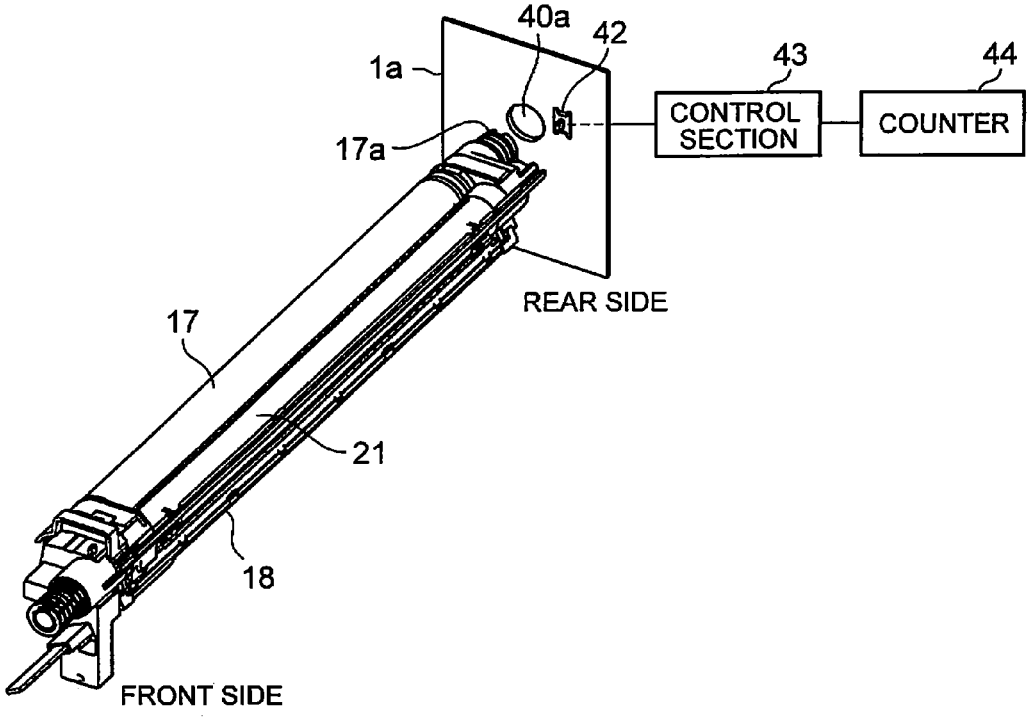
FIG. 4 is a schematic perspective view of the image forming unit viewed from a cleaner side and a schematic block diagram for mainly explaining maintenance control for the process unit.
Figure 5:
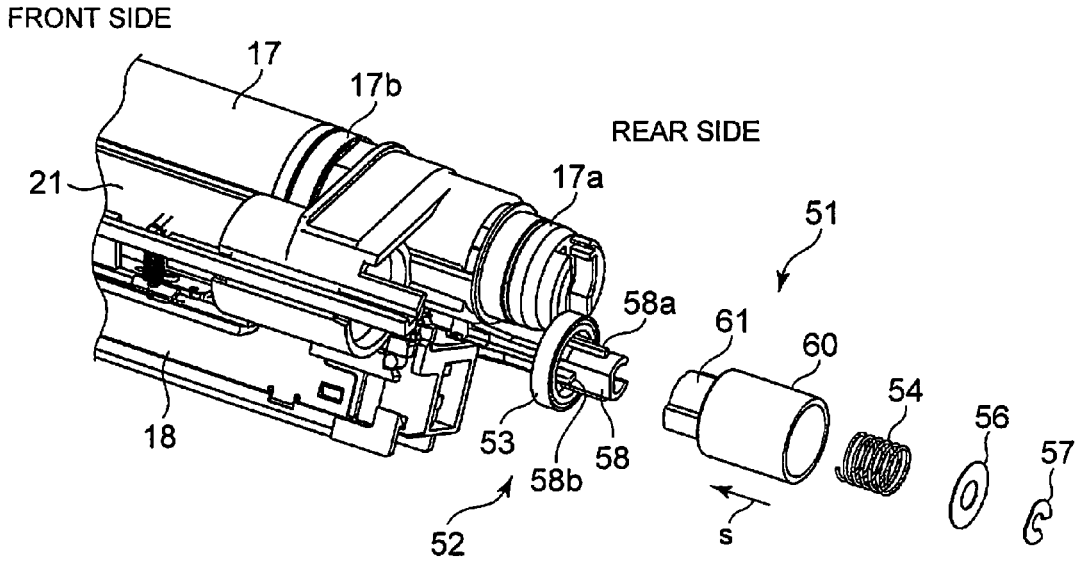
FIG. 5 is an exploded perspective view of the cleaner from which an auger and a pusher on the rear side of the cleaner are detached.
Figure 6:
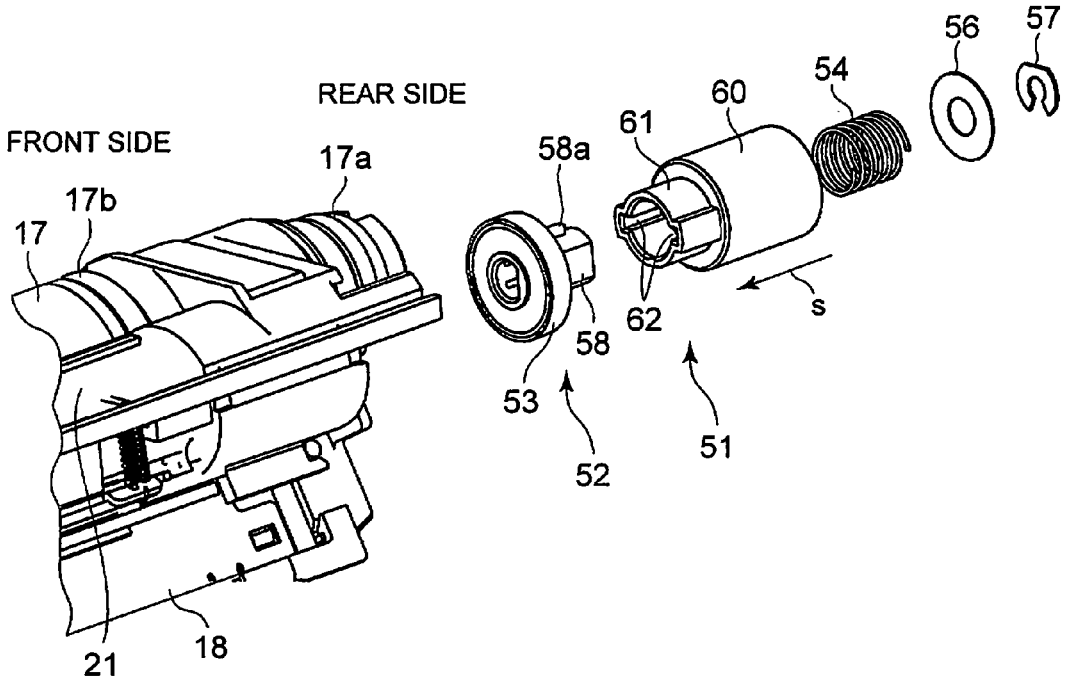
FIG. 6 is an exploded perspective view of the cleaner shown in FIG. 5 viewed from the opposite side.
Figure 7:
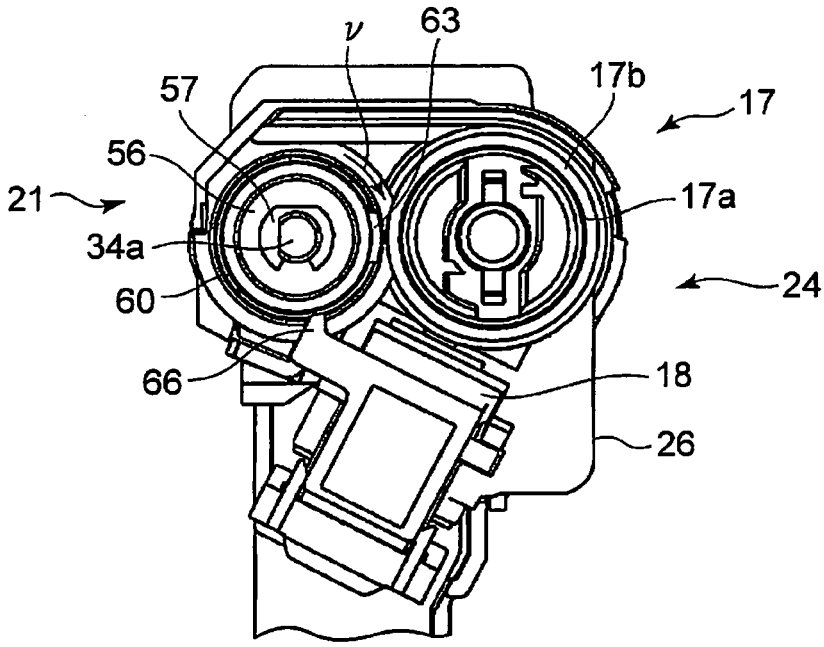
FIG. 7 is a schematic plan view of the process unit viewed from the rear side.
Figure 8:
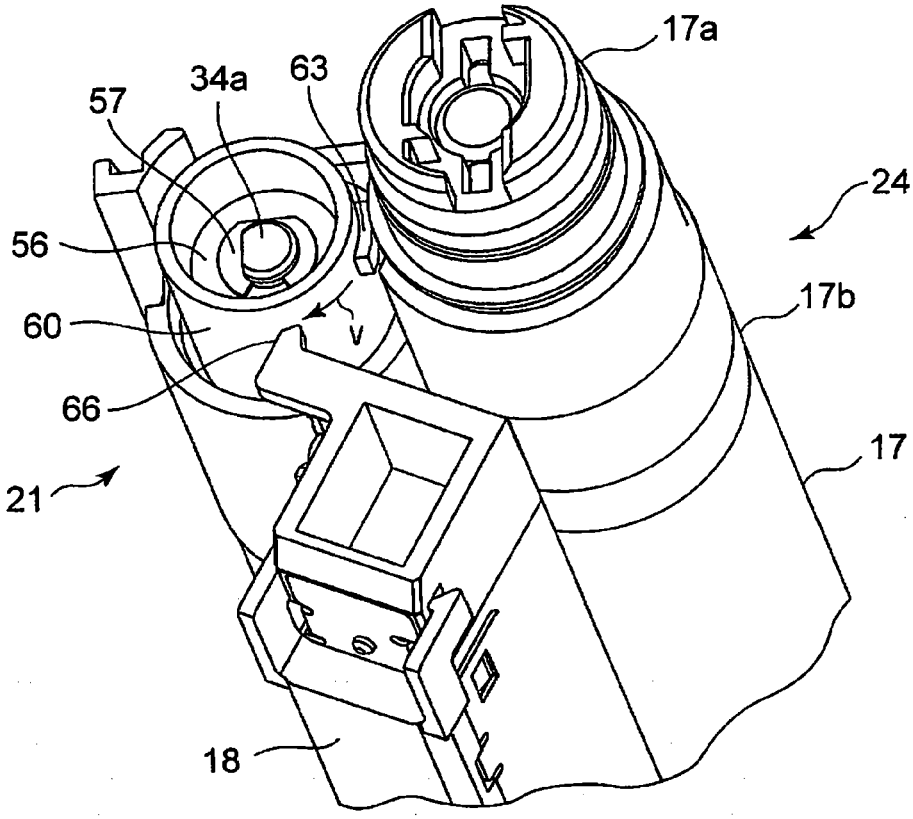
FIG. 8 is a schematic perspective view of the rear side of the process unit.

The process units 24Y, 24M, 24C, and 24K are explained in detail. Since the process units 24Y, 24M, 24C, and 24K have the same structure, common reference numerals and signs are used for the explanation. As shown in FIGS. 3 and 4, the housing 1 includes a positioning hole 40*a*, a positioning hole 40*b*, and a sensor 42 in a rear frame 1*a*. The process unit 24 includes, on the rear side, a drum end 17*a* inserted through the positioning hole 40*a* of the rear frame 1*a* of the housing 1 and a positioning pin 50 inserted through the positioning hole 40*b* of the rear frame 1*a* of the housing 1.

The sensor 42 inputs an ON-OFF signal to a control section 43. If the process unit 24 is replaced or expendable supplies of the process unit 24 are replaced and the sensor 42 is switched from ON to OFF, the control section 43 determines that maintenance of the process unit 24 ends. If the control section 43 determines that the maintenance of the process unit 24 ends, the control section 43 resets, for example, a counter 44 for maintenance. If a specified time elapses after the counter 44 is reset or if a specified number of sheets are printed and the counter 44 reaches a fixed count value, the control section 43 determines that maintenance of the process unit 24 is necessary. The control section 43 displays, for example, on a control panel 10*a* of the MFP 10, a message that timing for maintaining the process unit 24 comes.

The toner auger 34 includes, at the end on the rear side, a detecting mechanism 51 shown in FIGS. 5 to 8. The toner auger 34 rotates following a drum gear 17*b* of the photoconductive drum 17. The detecting mechanism 51 present on the rear side of the shaft 34*a* of the toner auger 34 includes a gear unit 52, which is a positioning section, and a cylinder-like pusher 60, which is a moving section. The gear unit 52 includes an auger gear 53, which is a coupling section, a spring 54, which is an elastic section, a washer 56, and a clip 57. The auger gear 53 fits in the shaft 34*a* of the toner auger 34 and moves in association with the shaft 34*a*. The spring 54 is provided in the pusher 60. The spring 54 presses the pusher 60 in the direction of the toner auger 34 between the washer 56, fixed to the shaft 34*a* of the toner auger 34 by the clip 57, and the pusher 60.

A coupling gear 58 of the auger gear 53 coupled to the pusher 60 includes protrusions 58*a* formed in a convex shape in cross section. The protrusions 58*a* are arranged in opposed two places in the outer circumference of the coupling gear 58. The pusher 60 includes, in opposed two places in the inner circumference of a head 61, groove-like keys 62 formed in a concave shape in cross section.

The pusher 60 is arranged in a first position close to the toner auger 34 and a second position away from the toner auger 34 according to a position with respect to the auger gear 53 in a rotating direction. If the protrusions 58*a* in the two places of the coupling gear 58 and the keys 62 in the two places of the pusher 60 fit in each other, the pusher 60 is pressed in an arrow s direction by the spring 54 to move close to the toner auger 34. In a state in which the protrusions 58*a* of the coupling gear 58 collide with the end of the head 61 of the pusher 60, the pusher 60 is separated from the toner auger 34 irrespective of a pressing force of the spring 54. A stopper 58*b* of the coupling gear 58 regulates a slide of the pusher 60 in the arrow s direction if the protrusions 58*a* of the coupling gear 58 fit in the keys 62. The protrusion 58*a* of the coupling gear 58 and the key 62 of the pusher 60 may be each arranged only in one place.

The pusher 60 includes a protrusion 63 in the outer circumference. The charger 18 includes a hook 66, which is a stopper, at the end on the rear side. If the pusher 60 is present in the second position, the hook 66 catches the protrusion 63. If the pusher 60 is present in the first position, phases of the protrusion 63 and the hook 66 in the direction of the shaft 34*a* of the toner auger 34 shift from each other.

Figure 9:
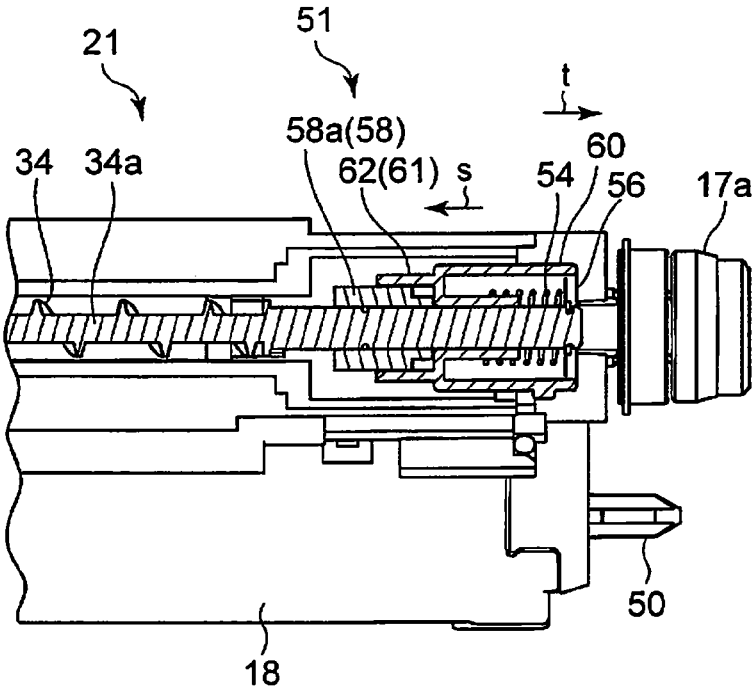
FIG. 9 is a schematic explanatory diagram of the pusher present in a first position.
Figure 11:
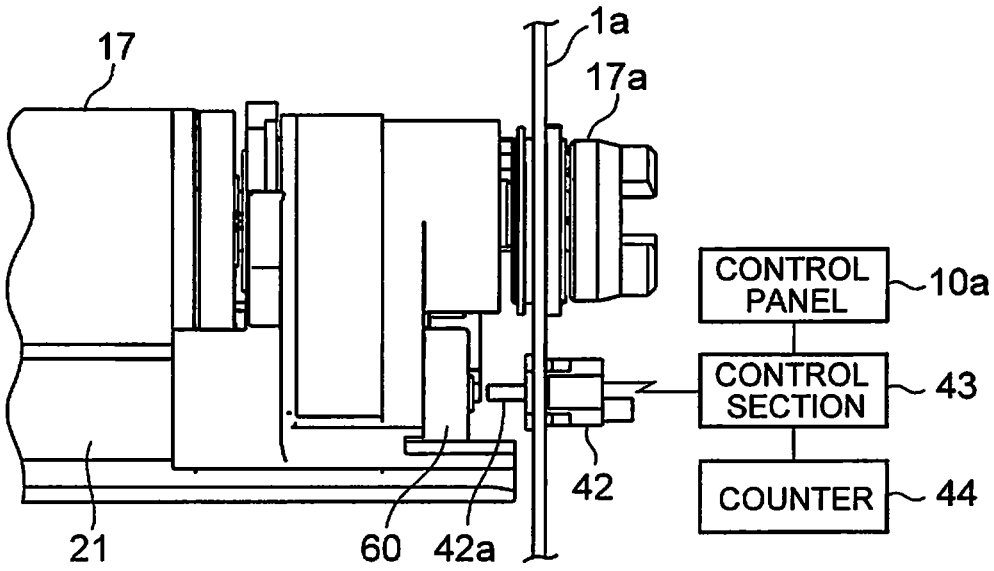
FIG. 11 is a schematic explanatory diagram of the pusher present in the first position and a sensor and a schematic block diagram for mainly explaining maintenance control for the process unit.

While the MFP 10 performs an image forming process, in the detecting mechanism 51 of the process unit 24, the protrusions 58*a* of the coupling gear 58 fit in the keys 62 of the pusher 60. The pusher 60 is pressed in the arrow s direction shown in FIG. 9 by the spring 54 along the shaft 34*a* of the toner auger 34. The pusher 60 is present in the first position close to the toner auger 34 and is away from an actuator 42*a* of the sensor 42 as shown in FIG. 11. The sensor 42 is off.

While the image forming process is performed, if the control section 43 determines necessity of maintenance of the process unit 24 from a count value of the counter 44, the control section 43 displays a message for urging the maintenance of the process unit 24 on the control panel 10*a*. The maintenance of the process unit 24 may be replacement of the photoconductive drum 17, the charger 18, or the cleaner 21 itself or replacement of expendable supplies or cleaning of the photoconductive drum 17, the charger 18, or the cleaner 21. An operator as a user or a serviceperson checks the display on the control panel 10*a* and performs the maintenance of the process unit 24. The operator may directly check a value of the counter 44 and perform the maintenance of the process unit 24.

For the maintenance, the operator draws out the process unit 24 from the front side of the housing 1. If the maintenance is not replacement of the cleaner 21 itself, the operator manually slides the pusher 60 of the detecting mechanism 51 in an arrow t direction along the shaft 34*a* of the toner auger 34. After pulling out the protrusions 58*a* of the coupling gear 58 from the keys 62 of the pusher 60 resisting a pressing force of the spring 54, the operator pivots the pusher 60 and shifts the phases of the keys 62 and the protrusions 58*a*. The operator brings the protrusions 58*a* of the coupling gear 58 into contact with the end of the head 61 of the pusher 60 and moves the pusher 60 to the second position away from the toner auger 34. In a new cleaner 21, the pusher 60 is set in the second position away from the toner auger 34.

Subsequently, the operator replaces expendable supplies that need to be replaced or performs maintenance such as cleaning of the photoconductive drum 17, the charger 18, or the cleaner 21. After the maintenance ends, the operator inserts the process unit 24, in which the pusher 60 is present in the second position, into the housing 1 from the front side. The operator sets the positioning hole 40*a* of the rear frame 1*a* and the drum end 17*a* in the same position, sets the positioning hole 40*b* and the positioning pin 50 in the same position, attaches the process unit 24 to the rear frame 1*a*, and closes a front cover.

Figure 10:
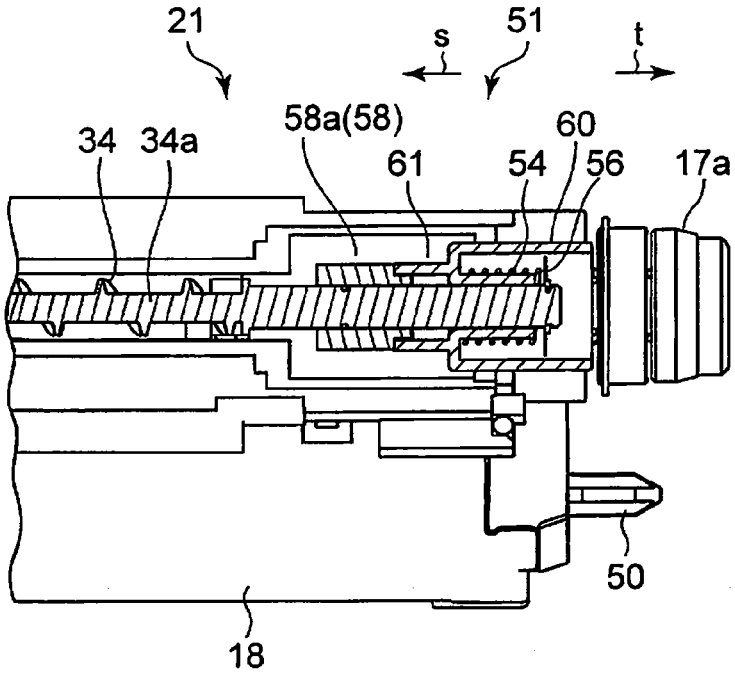
FIG. 10 is a schematic explanatory diagram of the pusher present in a second position.
Figure 12:
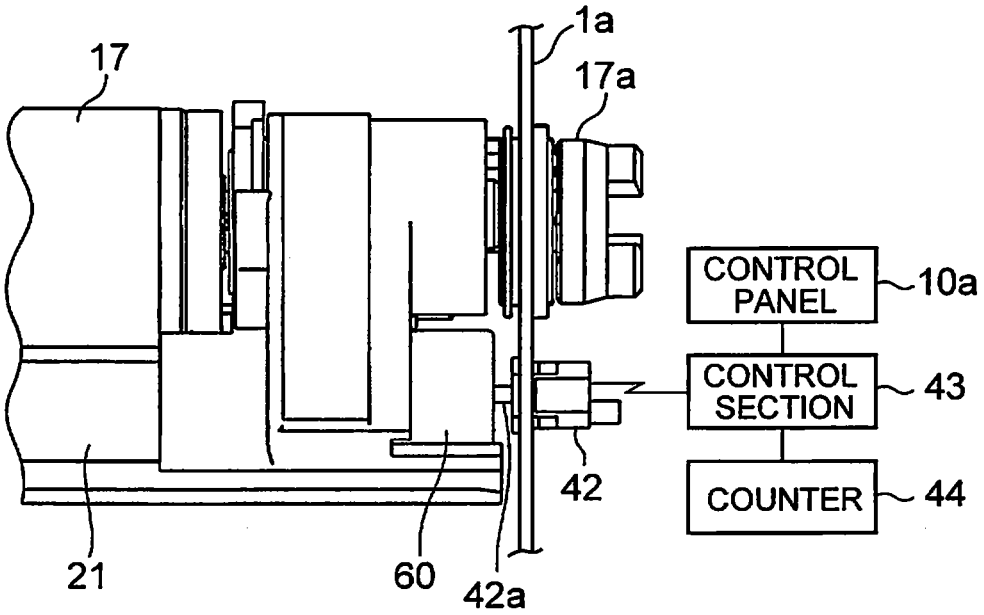
FIG. 12 is a schematic explanatory diagram of the pusher present in the second position and the sensor and a schematic block diagram for mainly explaining maintenance control for the process unit.

In the process unit 24 inserted in the housing 1, the pusher 60 of the detecting mechanism 51 is present in the second position shown in FIG. 10. If the pusher 60 is present in the second position, the actuator 42*a* of the sensor 42 is pushed by the pusher 60 as shown in FIG. 12. The sensor 42 is turned on by the pusher 60 present in the second position. The sensor 42 sends an ON signal to the control section 43.

After the maintenance, when the MFP 10 starts a first image forming process, the shaft 34*a* of the toner auger 34 rotates in an arrow v direction in association with the rotation of the photoconductive drum 17 of the process unit 24. If the auger gear 53 rotates according to the rotation of the shaft 34*a*, even in a state in which the protrusions 58*a* do not fit in the keys 62, the pusher 60 rotates in the arrow v direction following the auger gear 53. The pusher 60 rotates following the auger gear 53 with a friction force between the end of the head 61 of the pusher 60 and the protrusions 58*a* of the coupling gear 58 caused by a pressing force of the spring 54.

If the protrusion 63 of the pusher 60 that rotates following the auger gear 53 reaches the hook 66 provided in the charger 18, the hook 66 catches the protrusion 63 and stops the rotation of the pusher 60. On the other hand, the auger gear 53 continues the rotation in the arrow v direction. Therefore, the auger gear 53 moves to a position where the phases of the protrusions 58*a* and the keys 62 of the pusher 60 coincide with each other. The protrusions 58*a* of the coupling gear 58 fit in the keys 62 of the pusher 60. The pusher 60 is slid in the allow s direction by the spring 54 along the shaft 34*a* to move to the first position shown in FIG. 9 where the pusher 60 come into contact with the stopper 58*b*.

If the pusher 60 moves to the first position, as shown in FIG. 11, the pusher 60 separates from the actuator 42*a* of the sensor 42. If the pusher 60 moves to the first position, the sensor 42 is switched from ON to OFF. Since the sensor 42 is switched from ON to OFF, the control section 43 determines that the maintenance of the process unit 24 ends and resets the counter 44. The MFP 10 carries out the image forming process.

It is assumed that, during the maintenance of the process unit 24, for example, the operator forgets to attach the charger 18 and attaches the frame 26 to the housing 1. When the image forming process is started, the pusher 60 keeps on rotating following the auger gear 53 with the friction force with the coupling gear 58 in a state in which the pusher 60 is in the second position. Even if a fixed time elapses after the image forming process is started, the sensor 42 is not switched from ON to OFF. Since the sensor 42 is not switched from ON to OFF, the control section 43 determines that the charger 18 is not attached. The control section 43 displays, for example, on the control panel 10*a*, a warning that the charger 18 is not attached. The operator checks the process unit 24 according to the warning.

According to this embodiment, after the process unit 24 is inserted into the housing 1, if the toner auger 34 is rotated, the gear unit 52 of the detecting mechanism 51 follows the toner auger 34 and moves the pusher 60 from the second position away from the toner auger 34 to the first position close to the toner auger 34. If the sensor 42 that detects the pusher 60 is switched from ON to OFF, the control section 43 determines that the maintenance of the process unit 24 ends. If the maintenance of the process unit 24 is performed, the process unit 24 is only inserted into the housing 1, whereby the MFP 10 can determine that the maintenance of the process unit 24 ends. Maintenance operation for resetting the counter during the maintenance or maintenance operation for replacing of a determination component by the operator, the serviceperson, or the like is unnecessary. Costs for the determination component are saved.

According to this embodiment, the hook 66 for surely performing the movement of the toner auger 34 by the gear unit 52 is provided in the charger 18. If the sensor 42 is not switched, it is determined that the attachment of the charger 18 is forgotten. Consequently, a human error during the maintenance is prevented.

The structure of the process unit according to this embodiment is not limited. For example, the process unit may integrally include a developing device. In the process unit including the developing device, a developing roller, an agitating auger, or the like may be used as the rotating section.

Figure 13:
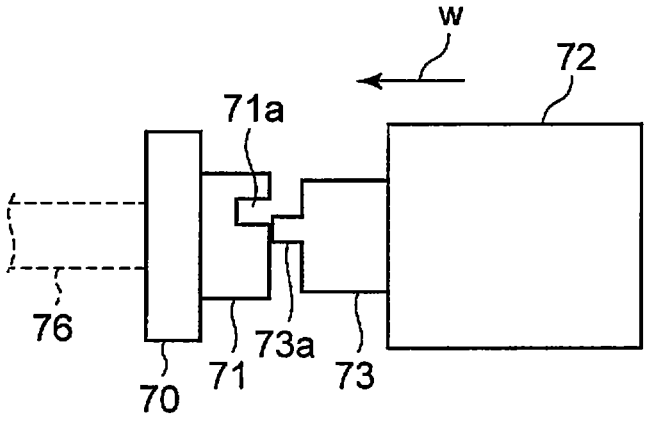
FIG. 13 is a schematic explanatory diagram of a cutout of a coupling gear and a key of a moving section in a modification.

The shapes of the keys and the coupling section in this embodiment are not limited either. As indicated by a modification shown in FIG. 13, it is also possible that a concave cutout 71*a* is formed at a distal end 71 of a coupling gear 70, a convex key 73*a* is formed at a distal end 73 of a moving section 72, the key 73*a* is fit in the cutout 71*a*, and the moving section 72 is moved from a second position to a first position. As shown in FIG. 13, if the key 73*a* collides with the distal end of the coupling gear 70, the moving section 72 is present in the second position away from a toner auger 76. If the key 73*a* fits in the cutout 71*a* of the coupling gear 70, the moving section 72 slides in an arrow w direction and moves to the first position close to the toner auger 76.

In this embodiment, a stopper for stopping the rotation of the moving section does not have to be provided in the charger as long as the stopper is provided around the moving section. In this embodiment, if an elastic force for urging the moving section in the direction of the first position is adjusted to reduce a friction force between the moving section and the coupling section such that the coupling section and the moving section slip each other when the first image forming process is stared after the maintenance, the stopper does not have to be provided. The positioning section only has to be a positioning section that can move the moving section following the rotating section and hold the moving section in the first position and the second position.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A process unit comprising:

a process section disposed proximate to an image bearing member and including a rotating section, the process section being attachable to and detachable from a body and configured to apply a process to the image bearing member;

a moving section disposed on a shaft of the rotating section and including a key, the moving section configured to slide between a first position close to the rotating section and a second position away from the rotating section; and a positioning section disposed between the rotating section and the moving section and configured to follow movement of the rotating section and to hold the moving section in the first position and the second position, the positioning section including a coupling section configured to hold the moving section in the first position if a portion of the coupling section fits in the key and to hold the moving section in the second position if the portion of the coupling section does not fit in the key, and an elastic section configured to press the moving section in a direction of the first position.

2. The unit according to claim 1, wherein the process section includes a cleaner configured to remove toner on the image bearing member, and the rotating section is a toner auger for the cleaner.

3. The unit according to claim 2, further comprising a stopper provided adjacent to the cleaner and configured to stop rotation of the moving section.

4. The unit according to claim 3, wherein the moving section includes a protrusion on an outside, and the stopper is arranged in a charger configured to charge the image bearing member and contacts the protrusion if the moving section is present in the second position and separates from the protrusion if the moving section is present in the first position.

5. An image forming apparatus comprising:

a body;

an image bearing member housed in the body;

a process section disposed proximate to an image bearing member and including a rotating section, the process section being attachable to and detachable from the body and configured to apply a process to the image bearing member;

a moving section disposed on a shaft of the rotating section and including a key, the moving section configured to slide between a first position close to the rotating section and a second position away from the rotating section;

a positioning section disposed between the rotating section and the moving section and configured to follow movement of the rotating section and to hold the moving section in the first position and the second position, the positioning section including a coupling section configured to hold the moving section in the first position if a portion of the coupling section fits in the key and to hold the moving section in the second position if the portion of the coupling section does not fit in the key, and an elastic section configured to press the moving section in a direction of the first position;

a sensor configured to detect a position of the moving section; and a control section configured to determine a state of the process section from a detection result of the sensor.

6. The apparatus according to claim 5, wherein the process section includes a cleaner configured to remove toner on the image bearing member, and the rotating section is a toner auger for the cleaner.

7. The apparatus according to claim 6, further comprising a stopper provided adjacent to the cleaner and configured to stop rotation of the moving section.

8. The apparatus according to claim 7, wherein the moving section includes a protrusion on an outside, and the stopper is arranged in a charger configured to charge the image bearing member and contacts the protrusion if the moving section is present in the second position and separates from the protrusion if the moving section is present in the first position.

* * * * *